US005533701A

United States Patent [19]

Trank

[11] Patent Number: 5,533,701

[45] Date of Patent: Jul. 9, 1996

[54] FOLDABLE STABILIZING BRACKET FOR COMPRESSED AIR TANKS

[76] Inventor: Robert D. Trank, 331 SE. 8th St., Pompano Beach, Fla. 33060

[21] Appl. No.: 351,689

[22] Filed: Dec. 8, 1994

[51] Int. Cl.[6] ..... A47G 1/10

[52] U.S. Cl. ..... 248/316.4; 248/286.1; 248/292.12

[58] Field of Search ..... 248/316.1, 316.4, 248/316.8, 274, 311.2, 313, 286.1, 292.12, 298.1, 292.14; 224/926, 522, 536

[56] References Cited

U.S. PATENT DOCUMENTS

| | | | |
|---|---|---|---|
| 2,550,019 | 4/1951 | Murphy | 248/311.2 |
| 2,942,830 | 6/1960 | Senay | 248/316.4 |
| 3,712,257 | 1/1973 | Alleaume | 114/74 A |
| 3,780,972 | 12/1973 | Brodersen | 248/313 |
| 3,823,907 | 7/1974 | Ziaylek | 248/313 |
| 4,023,761 | 5/1977 | Molis | 248/313 |
| 4,304,383 | 12/1981 | Huston | 248/313 |
| 4,442,991 | 4/1984 | Levens | 248/146 |
| 4,555,083 | 11/1985 | Carter | 248/313 |
| 4,586,687 | 5/1986 | Ziaylek | 248/313 |
| 4,828,211 | 5/1989 | McConnell | 248/316.4 |
| 5,072,909 | 12/1991 | Huang | 248/311.2 |
| 5,318,266 | 6/1994 | Liu | 248/311.2 |

*Primary Examiner*—Karen J. Chotkowski
*Assistant Examiner*—Gwendolyn Wrenn-Baxter
*Attorney, Agent, or Firm*—Mslin, Haley, DiMaggio & Crosby

[57] ABSTRACT

A bracket for stabilizing a cylindrical compressed air tank suitable for scuba diving against a bulkhead of a boat, the bracket having an operating position where the bracket arms are extended perpendicular to the boat bulkhead for firmly holding a cylindrical tank in place while it rests on its base and pivotal arms that move downwardly flush with the bulkhead and parallel to in an out-of-the-way position when the bracket is not in use. The bracket is comprised of two identical components which can be interlocked together adjustably longitudinally in length to accommodate compressed air tanks of different diameters. Each bracket component has two separate pieces that have an interlocking hinge, both pieces of which can be molded so that the entire bracket can be fabricated at low cost.

6 Claims, 5 Drawing Sheets

FOLDABLE STABILIZING BRACKET FOR COMPRESSED AIR TANKS

BACKGROUND OF THE INVENTION

1. Field of the Invention

This invention relates generally to a bracket mounted on an inside cockpit wall of a boat for stabilizing and securely holding in place a cylindrical tank containing compressed air, used for scuba diving, and in particular, to an improved compressed air tank bracket that can be manually extended outwardly from the boat wall for stabilizing the compressed air tanks in one mode and collapsible against the boat wall (out of the way) in a second mode when not in use. The tank embracing bracket arms can be spatially adjustable to accommodate cylindrical compressed air tanks of different diameters. The left and right bracket components are identical in shape and therefore can be fabricated at relatively low cost.

2. Description of the Prior Art

Compressed air tanks for diving, known as scuba tanks, are in common use as underwater diving equipment. One (or more) tanks are strapped to the back of the diver when in use. Frequently, one diver will have available two or more tanks during a day of diving. Most scuba diving is accomplished from a boat. Any tank that is not in use must be stored on the deck of a boat. The inherent rolling action of the boat due to the wave motion of the water can cause the scuba tank to roll or move on the deck of the boat. Because of the weight and size of the tanks, such movement can be hazardous to personnel on the boat and the boat structure.

The storage of such tanks involves concerns, such as minimum available space (since space is often at a premium in these environments), and maximum holding strength to securely hold a tank in position against external forces on the boat. Scuba tanks come in a variety of different diameters, adding to the complexity of the storage problem.

Many prior art mounting assemblies for scuba tanks tend to be sturdy but bulky. Typically, a sturdy bracket fits only one size tank. This results in a greatly increased number of mounting assemblies which must be designed and fabricated, which, in turn, increases manufacturing and purchasing costs. Moreover, with the use of past mounting assembles having the needed strength and durability, a user is limited to essentially the same size tank when making a replacement unless the user installs a different mounting assembly.

Brackets for holding compressed air tanks are known in the prior art. Ziaylek, Jr. U.S. Pat. No. 4,586,687, issued May 6, 1986 to discloses an air tank support of the quick release type. The device is characterized by having a plurality of parts with a handle for locking and unlocking the arms, with the entire device being mounted to a fixed surface. U.S. Pat. No. 4,023,761, issued May 17, 1977 to Molis, shows upright braces that include releasable collars that fit around a compressed air tank. Ziaylek, Jr. U.S. Pat. No. 3,823,907, also issued Jul. 16, 1974, shows a complex bracket structure that provides for positive locking of a compressed air tank. Brodersen U.S. Pat. No. 3,780,972, issued Dec. 25, 1973, shows a mounting apparatus for compressed gas containers. Alleaume U.S. Pat. No. 3,712,257, issued Jan. 23, 1973, shows a device to prevent roll and pitch of a tank. Houston U.S. Pat. No. 4,304,383, issued Dec. 8, 1981, shows a bracket for holding a tank. Levens U.S. Pat. No. 4,442,991, issued Apr. 17, 1984, shows a cradle for storing cylindrical tanks that includes a fixed member with a cushion. Carter U.S. Pat. No. 4,555,083, issued Nov. 26, 1985, shows a fixed apparatus for mounting around a compressed air tank to prevent rolling. French Patent No. 1,352,534, issued to Leutwyler, shows a rigid bracket structure that can be adjusted laterally with two separable arms and a perforated surface.

One of the primary drawbacks of the brackets shown in the prior art is that when they are not in use, the bracket arms project outward from the bulkhead into boat cockpit space near the boat side wall. Specifically, in a boat environment with divers or swimmers walking around the boat cockpit or ingressing or egressing the boat cockpit, protruding arms sticking out from the bulkhead present a hazard.

The present invention overcomes these problems by providing a very sturdy bracket for vertically supporting a compressed air tank, especially useful on a boat for scuba diving, which when not in use or when the tanks themselves are not in their storage position, the bracket, and particularly the bracket arms, can be collapsed parallel to the boat wall, out of the way in a nonhazardous position.

SUMMARY OF THE INVENTION

A collapsible bracket for securely stabilizing a compressed air tank in a fixed, vertical position, typically inside a boat, and slidably connected to a bracket mounting track affixed to the inside wall of the boat. One or more brackets, in accordance with the present invention, are slidably mounted to a fixed, horizontally-disposed track that is securely connected to the inside wall (bulkhead) of a boat. The track is attached by threaded connectors or the like.

An air tank for scuba diving containing compressed air is cylindrical with a flat bottom. In the operating mode of the bracket, the tank is stored by having the flat tank base rest on the boat cockpit floor with the bracket engaged circumferentially around a portion of the tank circumference.

The improved bracket has two separate, pivotally extendable, hinged arms, each arm capable of two different positional modes, the first mode being in a horizontal position wherein a compressed air tank is secured in place vertically, and in a second mode, out of the way, substantially parallel and flush against the inside wall of the boat.

The bracket body structure has two interlocking but separable (identical) components that permit relative spacial adjustment between each other to accommodate cylindrical air tanks of different diameters. The diametral adjustment is manual and since each bracket structural component has rows of spaced-apart teeth which are identically sized, adjustment is achieved by manually selecting and interlocking each row of teeth in each component at the desired longitudinal position to achieve a desired arm separation that equals tank diameter size.

The two-position operation of the bracket is achieved by hinges in each structural component of the bracket. Each component is comprised of 1) a rigid, straight track engaging connector brace that is sized to slide onto a C-shaped grooved track that is permanently mounted to the boat wall, with the brace having at one end a hinge axle extending member, and 2) a curved arm having a hinge passage sized to receive the brace hinge axle. The hinge joint allows 180° pivotal rotation between the bracket arm and the brace. The hinge joint also includes shaped surface areas that provide cam stop positions so that each arm can be locked at a desired position by cam stop positions.

To utilize the bracket, which would be placed on a scuba diving boat, first the bracket dual components are joined together manually with each component being mated to the opposing component for a selected diameter size of the tank. Opposing brace interlocking teeth are manually interlocked longitudinally to achieve proper arm separation for tank diameter fit. Once the tank size is selected and the interlocking bracket components joined together manually, the assembled bracket is positioned manually and moved slidably into one end of the track that is permanently mounted to the boat wall. To mount a tank in the bracket, both bracket arms are manually extended pivotally, to project orthogonally from the bulkhead. A tank may be positioned adjacent the boat wall and dropped down through the horizontally extended arms of the bracket to hold the tank in place vertically. The tank can be vertically removed manually when desired. When the scuba tank is removed and the bracket is not needed, each arm of the bracket may be manually positioned parallel to the wall of the boat, out of the way.

Thus, the invention provides for a compressed air tank bracket that can be quickly and easily moved out of the way when not in use. Also, the bracket allows for a very simple manual adjustment to accommodate tanks of different diameter sizes.

The bracket can be fabricated at relatively low cost because each bracket component, which are separable, are identical in shape and form. This means that a single arm and brace combination, hinged together, can be utilized for each separable bracket component, allowing for the use of only two fabricating molds, one for the brace and one for the arm, to accomplish the entire bracket. This allows for reduced fabrication cost. One bracket fits most tank sizes.

The bracket may be made of a very tough polypropylene plastic in a molded form and is quite durable, especially in a marine environment.

It is an object of this invention to provide an improved bracket for stabilizing and securely supporting compressed air tanks typically used for scuba diving and especially useful in a boat environment that can be readily folded out of the way when not in use.

It is another object of this invention to provide an improved bracket for use with scuba tanks or other compressed air tanks for securely stabilizing the tanks in a fixed position, typically vertically, while allowing for easy manual adjustment for different diameter sized tanks.

But yet still another object of this invention is to provide a compressed air tank bracket and hinge joint that can be fabricated at relatively low cost by having the bracket be comprised of two identical components that can be interlocked together manually and which can be separated when removed from the boat track for storage and shipping purposes.

In accordance with these and other objects which will become apparent hereinafter, the instant invention will now be described with particular/reference to the accompanying drawings.

DESCRIPTION OF THE PREFERRED EMBODIMENTS

Figure 1:
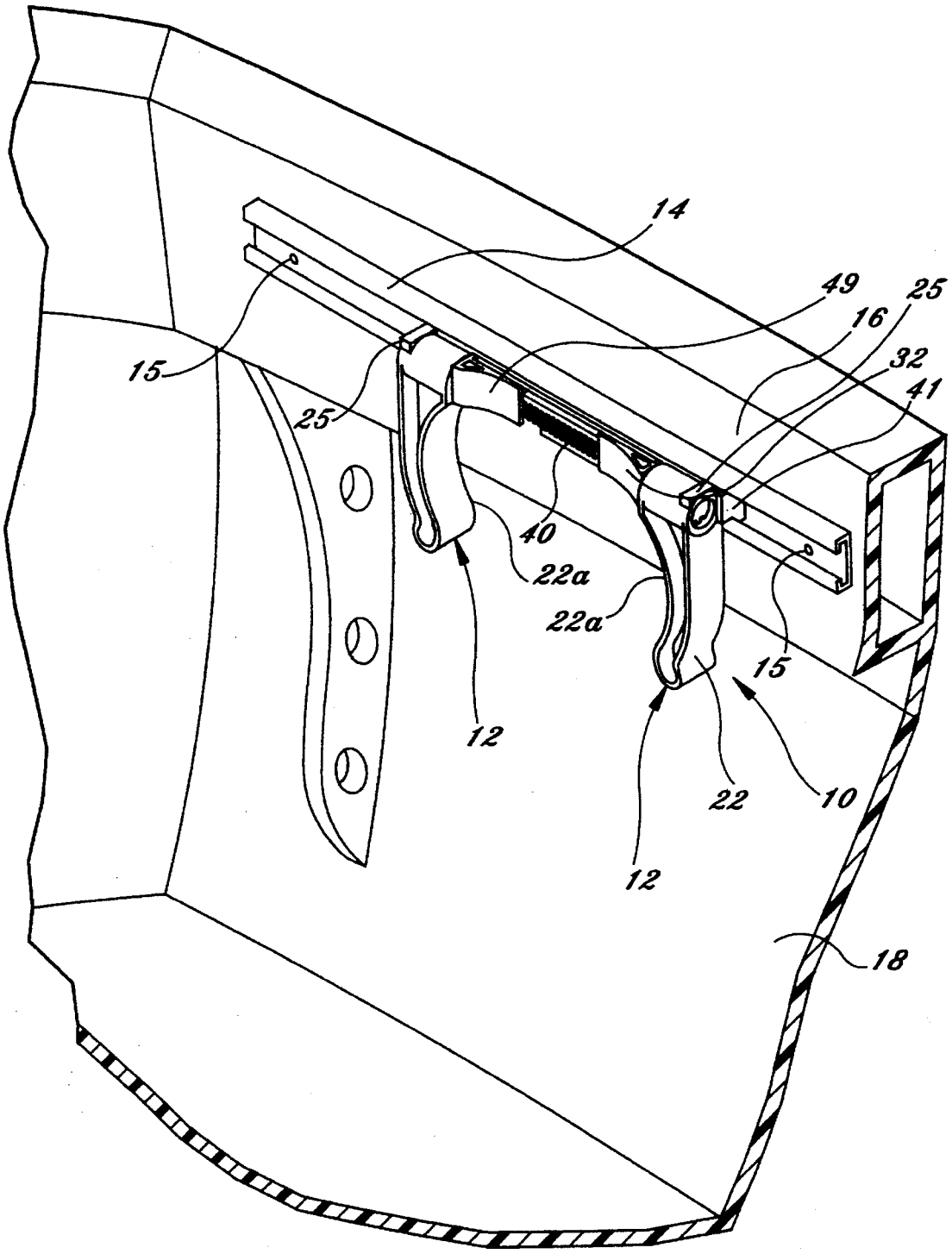
FIG. 1 shows a cut away view in perspective of the wall of a boat that includes a perspective view of the invention in the stored position.
Figure 2:
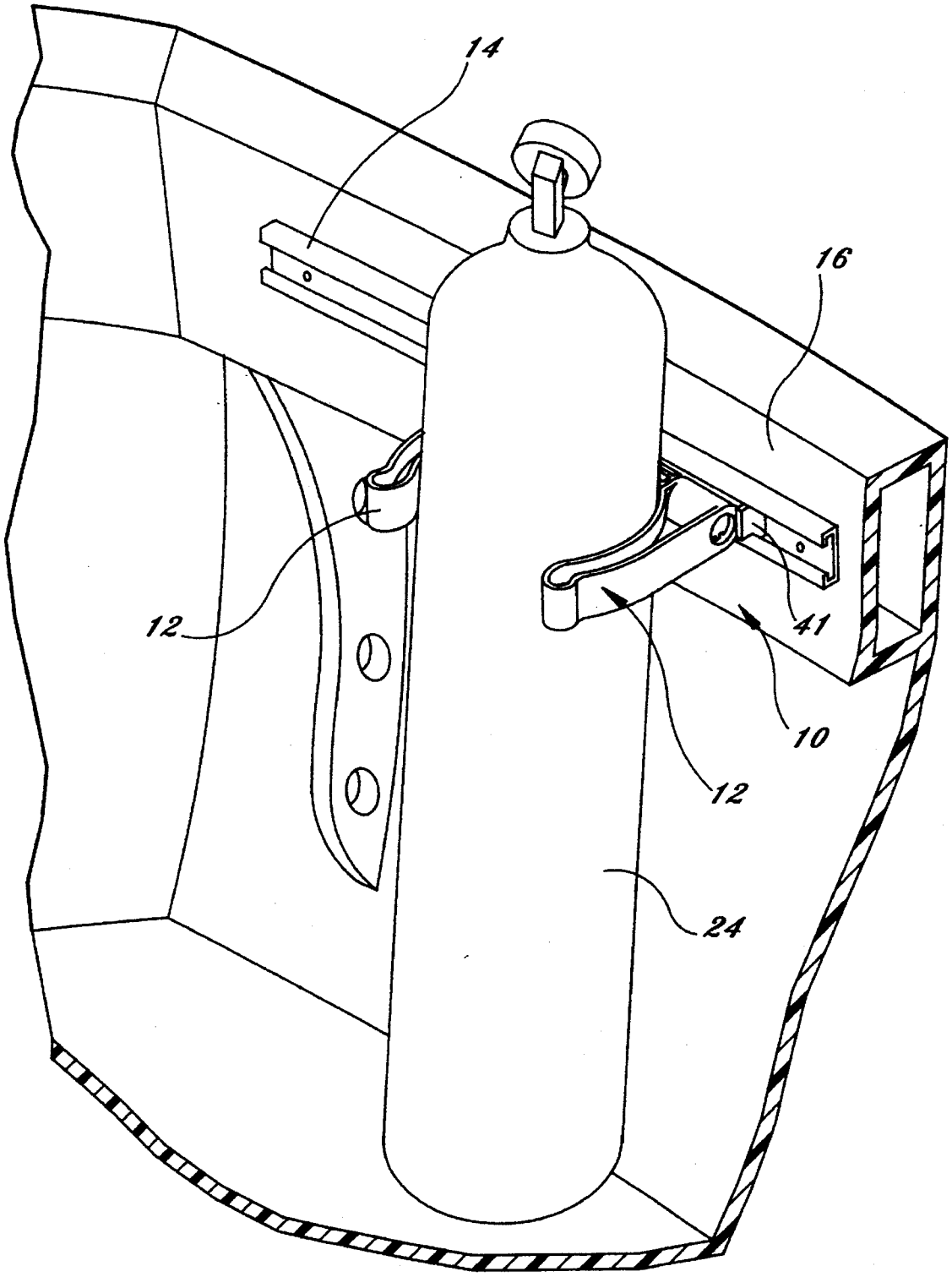
FIG. 2 shows a cut away, perspective view of a boat wall that includes a compressed air tank, such as a scuba tank, vertically disposed, with the present invention being used in the operable extended position for holding the tank securely in place.
Figure 3:
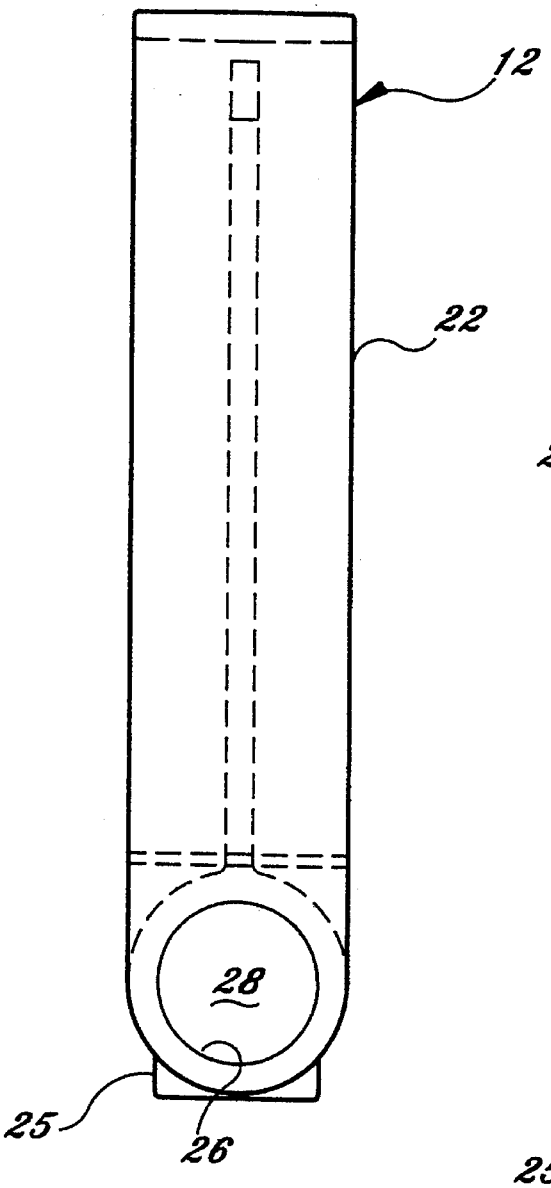
FIG. 3 shows a side elevational end view of one side of an arm used in the present invention.
Figure 4:
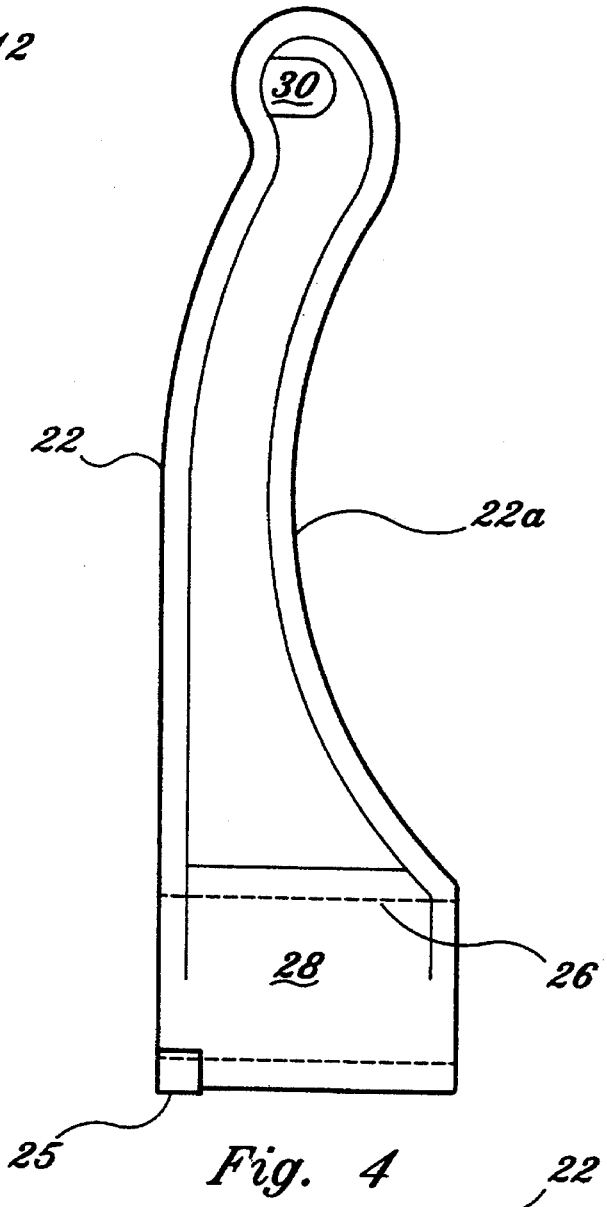
FIG. 4 shows a top plan view of an arm used in the present invention.

Referring now to the drawings, and in particular FIGS. 1 and 2, a pivotal bracket assembly comprised of bracket 10 and a C-shaped mounting bar 14 is shown. The bracket 10 is used for securely storing and stabilizing a compressed air tank 24 in a fixed vertical position. The bracket 10 is typically used inside a boat, and is connected to track 14 which is affixed to the inside wall 16, forming a part of a boat bulkhead 18. A fastener 15 may be used to permanently mount the track 14 against the boat wall 16. As shown in FIGS. 1 and 2, each bracket 10 would hold a single tank in a vertical, stabilized position. Typically, compressed air tanks used for scuba diving are cylindrical and have a flat bottom with a tapered top, are often quite heavy, and come in different sizes with different diameters. FIG. 1 shows bracket 10 in a non-operational mode or a stored position in which the arms, having surface portions **22*a*, are flush parallel to bulkhead 18. FIG. 2 shows the operational mode of bracket 10 with the arms extended perpendicular to bulkhead 18 and encompassing a portion of the tank periphery to firmly hold the tank 24 in a vertical position. Although not necessarily readily discernible in FIGS. 1 and 2, the bracket 10 is, in fact, comprised of two separate components 12, which are identical in shape, size, and configuration. The pair of components 12 interlock along a row of teeth 40, which permits a predetermined spacing between the arm surfaces 22*a* to adjust for different sized tanks. Such an adjustment and, in fact, the interlocking of each bracket component 12, is accomplished prior to mounting the total bracket within track 14**.

Each bracket component 12 is comprised of a movable arm 22 shown in FIGS. 3, 4, 5, and 6 and a rigid, straight brace or beam 32 that pivotally attaches to arm 22 and slidably attaches to track 14.

Referring to FIGS. 3, 4, 5, and 6, rigid arm 22 includes an arcuate concave portion **22*a*. Each arm 22 is sized in length to insure that there is sufficient extension away from a bulkhead to encompass a substantial portion of the perimeter of a cylindrical tank. Therefore, the interior curved concave portion 22*a*** is curved substantially to accommodate a conventional scuba compressed air tank in terms of the overall shape and proportion of the tank.

Figure 5:
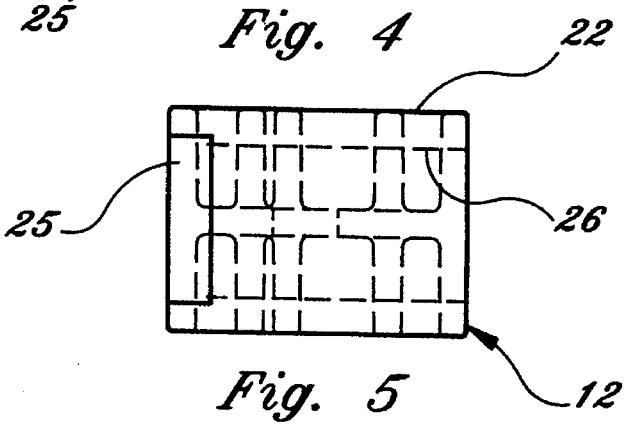
FIG. 5 shows an end elevational view of the leg of the bracket used in the present invention.

Each arm 22 also includes a cylindrical passage 28 that forms the passageway for a hinged joint described below. The passage is disposed across one end, the wider end, of the arm from side to side. Near one end, on the exterior side of each arm 22, is an arm stop 25 for engaging beam 32 thereby locking arm 22 in position. FIG. 5 shows an end elevational view of arm 22. The interior wall 26 which forms the circular wall passage 28. Each arm of the bracket is identical in size, shape, and configuration. Each arm, and especially the hinged passage 28, interlocks with an axle 36 disposed on beam 32 shown in FIG. 6.

FIGS. 6, 7, 8, and 9 show a beam 32 which is a rigid, straight bar that has several independent functions. The rigid bar includes an axle comprised of a rigid member 36 having arcuate-shaped outer portions 36a. The axle 36 is rigidly formed as part of the overall beam 32 and extend from a wall having short arcuate portion 49 formed as part of the structure. Wall surface 49 is also curved to accommodate a cylindrical tank and incorporates a stop 41 for securing the exterior cylindrical portion of arm 22 while allowing pivotal rotation of arm 22 relative to beam 32.

Beams 32 as shown in FIGS. 6, 7, 8, and 9 also include a plurality of rectangular teeth 40 spaced apart by an equal or substantially equal sized spacing so that the same size tooth on another member can fit between each tooth 40 for interlocking purposes. The teeth are disposed perpendicular to the longitudinal axis of beam 32 and allow for interlocking with an identical or almost identical beam member to adjust the overall longitudinal length of two beam members when locked together. This provides for predetermined spacing of the arms 22 when the bracket components are connected and interlocked together before it is mounted in the track 14 shown in FIG. 1.

Beam 32 also includes a flange 41 disposed perpendicularly at one end adjacent axle 36 to firmly hold the arm once attached hingedly to the axle 36 in place to prevent relative movement.

Figure 6:
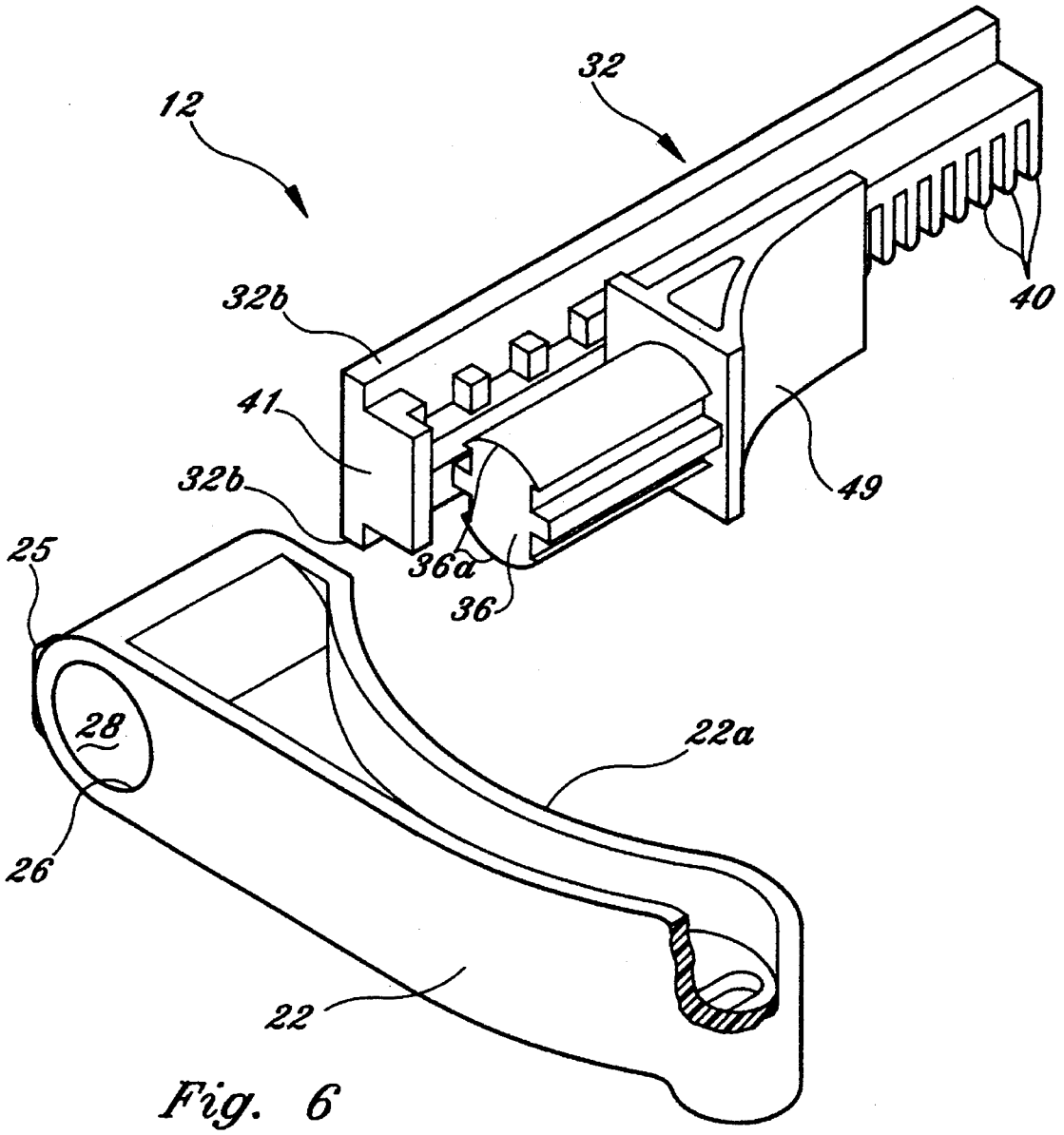
FIG. 6 shows an exploded view of the bracket hinge joint and moveable arm.

Beam 32 as shown in FIG. 6 also includes rectangular flanges 32*b* on each side of the beam, which allows the beam 32 to interlock into the C-shaped channel in track 14 as shown in FIG. 1, allowing the bracket to be slidably mounted to the track 14.

As shown in FIG. 6, arm 22 is exploded away from axle 36 which fits into passage 28, defined by a wall structure 26 and locked against the beam by flanged stop 41. Movable arms 22 each incorporate a protruding portion 25 for engaging beam 32 for holding an arm 22 in a cantilevered configuration as depicted in FIG. 2. This allows the arm 22 to be locked in at least three positions. By manually rotating arm 22, protruding portions 25 will move into engagement with beam 32 which firmly holds the arm 22 in place until it is manually overridden to the other positions. Although the arm and beam are shown exploded in FIG. 6, once they are attached at the factory, they remain as one component of a two-part bracket. The other component is identical so that in the manufacturing process, a mold is formed for arm 22 and a mold is formed for beam 32 which accounts for construction of the entire bracket.

Figure 9:
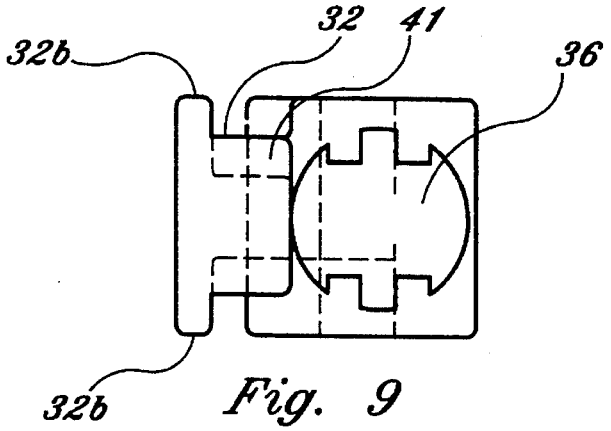
FIG. 9 shows an end elevational view of the same leg shown in FIG. 5 from the opposite end.
Figure 7:
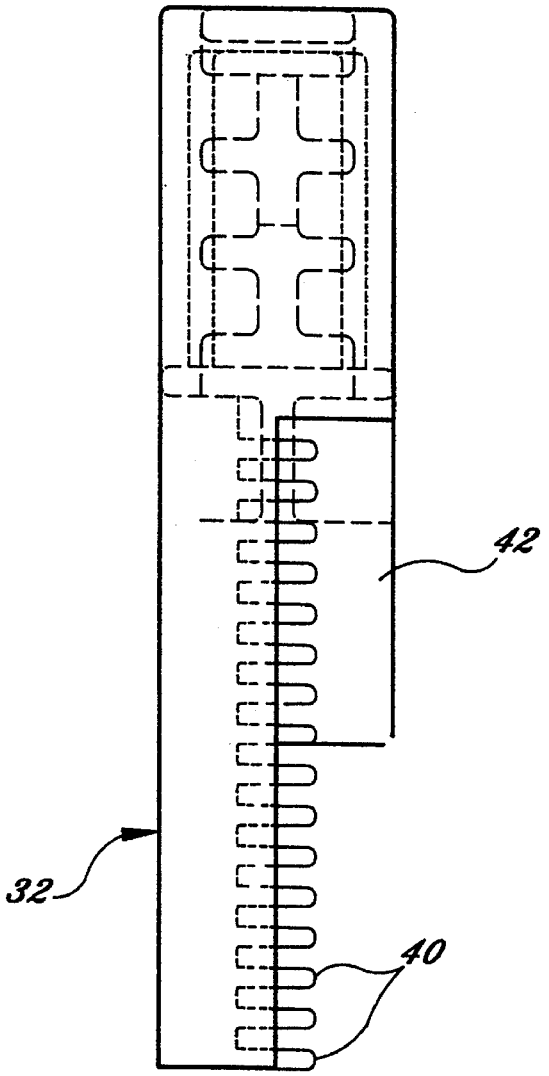
FIG. 7 shows a top plan view of the leg used in the present invention.
Figure 8:
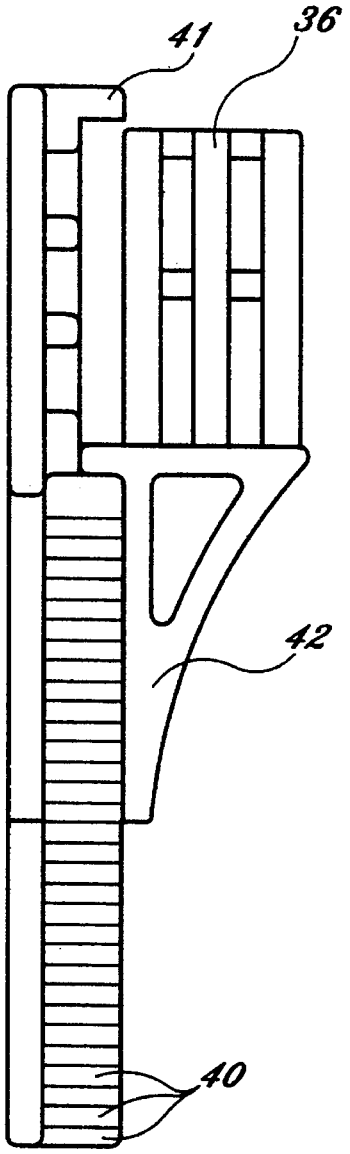
FIG. 8 shows a bottom plan view of the leg used in the present invention.

FIG. 7 shows the projecting teeth 40 which are spaced apart equally the size of teeth width so that they can be interlocked against a comparable identical component beam 32 in the adjustment process prior to mounting the bracket in the track. FIG. 9 shows axle 36, the flange 41, and flanges 32b that hold the beam 32 onto track 14 shown in FIG. 1.

To install a bracket in accordance with the invention, two separate bracket components 12 would be selected. Each component being comprised of a beam 32 and a pivotal arm 22. Once the tank size is known and the diameter of the tank is determined, each separate component is interlocked together a proper longitudinal relative distance through teeth 40 so that the arms 22 are separated between curved surfaces 22*a* the desired diameter distance for receiving the compressed air tank. The two components are interlocked manually together at the desired distance longitudinally. The entire bracket is then mounted into one end of a track 14 shown in FIG. 1 and moved along the track to the desired location. If there is no need to store a tank at any given time, the arms 22 are manually rotated or pivoted until they are flush with the bulkhead of the wall. This is the non-operational position.

When it is time to mount a tank in the bracket, each arm is independently rotated perpendicular to the bulkhead of the boat and the tank then dropped down through the opening formed between the pair of arms together, or inserted by moving the tank in the direction of beam 32 such that arms 22 snap into engagement.

The component elements which are molded from a rigid polypropylene plastic resist moisture and water found in a boating environment. Other materials may be suitable for construction of the components.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A bracket assembly for stabilizing a cylindrical compressed air tank in a vertical position, said bracket comprising:

a mounting track having a channel disposed therein longitudinally;

means connectable to said mounting track for attaching said mounting track to a surface; and a bracket connected to said mounting track, said bracket including a pair of arms, each of which is movable from a first position substantially perpendicular to said mounting track and a second position substantially orthogonal to said mounting track and to said arm first position, said pair of arms spaced apart in a predetermined distance to substantially engage a portion of the cylindrical compressed air tank in order to hold the cylindrical compressed air tank in a predetermined position relative to said mounting track, said bracket arms are movable from said first position to allow stabilizing engagement with a compressed air tank to said second, non-extending position;

said bracket of two identical components, each forming substantially half of said bracket and each separable from each other, said bracket component having a rigid, elongated brace, said brace including a means for attaching said brace to said mounting track, said brace including an interlocking means for interlocking one of said braces forming a bracket component to another identical brace having interlocking means, each of said bracket identical components including one of said arms for encompassing a portion of the circumference of said cylindrical compressed air tank; and each bracket component having a hinge joint connecting said brace and said arm to allow pivotal movement of said arms relative to said brace.

2. A bracket assembly as in claim 1, wherein:

said hinge joint being comprised of an elongated axle member connected to said brace, and said arm having an end incorporating a hinged passage for receiving said axle member to permit pivotal movement between said arm and said brace, said hinge axle including a locking means for locking said brace to said arm in a hinged pivotal position.

3. A bracket assembly as in claim 2, wherein:

said locking means includes at least one protruding member disposed on the end of said arm, said arm having an exterior contoured surface for engaging said brace for locking said arm in at least two positions relative to said brace.

4. A bracket assembly as in claim 2, wherein:

said brace includes a flange for engagement with said arm adjacent said hinge to prevent lateral movement of said arm relative to said brace.

5. A brace for stabilizing and holding a cylindrical compressed air tank in a desired position, comprising:

a first bracket component and a second bracket component, said first bracket component being substantially identical to said second bracket component, said first and second bracket components being interlockable together to form a tank holding bracket;

each of said first and second bracket holders comprising an elongated, rigid beam, said elongated beam having a straight longitudinal axis and including an axle member, said beam including a means for interlocking said beam to an identical beam having the same interlocking means, said interlocking means disposed substantially longitudinally relative to the longitudinal axis of said beam so that interlocking beams can be adjusted longitudinally in length and interlocked together at a predetermined length;

a rigid arm having at least a portion of said arm substantially arcuate in shape for engaging the cylindrical compressed air tank, said arm including a substantially cylindrical passage for receiving said axle member on said beam, forming a pivotal hinge between said arm and said beam, allowing said arm to pivot at least 90° from a first position to a second position relative to said beam, whereby when said first bracket component and second bracket component are interlocked together, they form a bracket that includes a pair of pivotal arms that can be moved from said first position relative to said beam to said second position relative to said beam for utilization in stabilizing a compressed air tank in said first position or in a non-use second position out of the way.

6. A bracket as in claim 5, wherein:

said arm having a contoured surface disposed circumferentially around said passage and including protruding portions for engaging said brace thereby locking said arm in a first position or a second position relative to said beam.

* * * * *